US006978996B2

(12) United States Patent
Strauss et al.

(10) Patent No.: US 6,978,996 B2
(45) Date of Patent: Dec. 27, 2005

(54) FLAT PRINTING MATERIAL-PROCESSING MACHINE WITH AN AUXILIARY PILE CARRIER

(75) Inventors: Peter Strauss, Frankenthal (DE); Michael Bantlin, Wiesloch (DE); Wolfgang Dolz, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 130 days.

(21) Appl. No.: 10/626,954

(22) Filed: Jul. 25, 2003

(65) Prior Publication Data

US 2004/0084829 A1 May 6, 2004

Related U.S. Application Data

(60) Provisional application No. 60/400,279, filed on Jul. 31, 2002.

(30) Foreign Application Priority Data

Jul. 25, 2002 (DE) ..... 102 33 786

(51) Int. Cl.[7] ..... B65H 31/04
(52) U.S. Cl. ..... 271/213; 271/218; 414/790.8
(58) Field of Search ..... 271/157, 158, 271/159, 213, 214, 218; 414/789.9, 790.8, 414/795.8; 101/474, 240, 232, 279; 198/851, 198/853

(56) References Cited

U.S. PATENT DOCUMENTS

| | | | | |
|---|---|---|---|---|
| 1,136,578 | A * | 4/1915 | Ayres | 198/853 |
| 3,902,711 | A * | 9/1975 | Lenoir | 271/67 |
| 3,951,401 | A * | 4/1976 | Marass | 271/158 |
| 3,975,011 | A * | 8/1976 | Marass | 271/157 |
| 4,452,442 | A * | 6/1984 | Geschwindner et al. | 271/204 |
| 5,295,681 | A * | 3/1994 | Blaser | 271/241 |
| 6,042,108 | A * | 3/2000 | Morgan et al. | 271/201 |
| 6,234,473 | B1 * | 5/2001 | Morgan et al. | 271/201 |
| 6,662,545 | B1 * | 12/2003 | Yoshida | 59/78 |
| 2002/0060398 | A1 * | 5/2002 | Zahn et al. | 271/145 |
| 2003/0146562 | A1 * | 8/2003 | Pittelkow | 271/18 |
| 2004/0140181 | A1 * | 7/2004 | Fandella | 198/851 |
| 2004/0262834 | A1 * | 12/2004 | Bantlin et al. | 271/157 |

FOREIGN PATENT DOCUMENTS

| | | |
|---|---|---|
| DE | 93 69 | 3/1955 |
| DE | 42 11 353 C2 | 10/1993 |
| DE | 42 15 791 A1 | 11/1993 |
| DE | 44 24 287 A1 | 1/1996 |
| DE | 296 10 103 U1 | 10/1996 |

* cited by examiner

*Primary Examiner*—David H. Bollinger
(74) *Attorney, Agent, or Firm*—Laurence A. Greenberg; Werner H. Stemer; Ralph E. Locher

(57) ABSTRACT

A machine for processing flat printing material, in particular a sheet processing rotary printing press, includes at least one processing station in the form of a printing unit, a feeder for loading the processing station with sheets of the printing material, a delivery for combining the processed sheets into piles, and an auxiliary pile carrier displaceable in an insertion direction from a standby position into an operational position and vice versa. Supporting members follow one another in the insertion direction and axially parallel swivel joints articulatingly connect the supporting members directly to one another. The supporting members have extensions projecting beyond the swivel joints thereof. One of the extensions directed counter to the insertion direction of a respective one of the supporting members engages underneath one of the extensions directed in the insertion direction of the respective supporting member after the next which trails in the insertion direction.

9 Claims, 7 Drawing Sheets

FLAT PRINTING MATERIAL-PROCESSING MACHINE WITH AN AUXILIARY PILE CARRIER

CROSS-REFERENCE TO RELATED APPLICATION

This application claims the benefit under 35 U.S.C. § 119(e) of copending U.S. Provisional Application No. 60/400,279, filed Jul. 31, 2002.

BACKGROUND OF THE INVENTION

Field of the Invention

The invention relates to a machine for processing flat printing material, in particular a sheet processing rotary printing press, having at least one processing station in the form of a printing unit, a feeder for loading the processing station with sheets, and a delivery for combining the processed sheets into piles. An auxiliary pile carrier is displaceable, in an insertion direction, from a standby position into an operational position and the reverse. Supporting members follow one another in the insertion direction. Axially parallel swivel joints articulatingly connect the supporting members directly to one another.

A machine equipped in that manner has been disclosed in German Published, Non-prosecuted Patent Application DE 42 15 791 A1.

In that machine, deposition elements in the form of chains are provided for transitorily carrying part of the printing materials. The deposition elements include inner and outer chain links connected articulatingly to one another via pins. The outer chain links have a U-shaped cross section, project half the pitch of the chain beyond the inner chain links, and have front sides which are rounded off starting from the closed side of the U-shaped cross section to the respective other front side.

When used as intended, the chains are supported at the respective ends thereof so that the open sides of the U-shaped cross sections are directed downwardly. In that regard, the chains serve as rod-shaped supports when they are loaded from the top side thereof. Each of the chains wraps around a transport sprocket and the free end of the respective chain run extending away from the transport sprocket is supported by a rod holding the chains in an outstretched position until the chains reach a crossmember or traverse supporting the chains in an operational position. The rod is moved back into an initial position thereof after the chain has become supported by the cross member.

The conventional chains are accommodatable in an extremely space-saving manner when the chains are not being used for a pile or stack change.

SUMMARY OF THE INVENTION

It is accordingly an object of the invention to provide a flat printing material-processing machine with an auxiliary pile or stack carrier, which overcomes the hereinafore-mentioned disadvantages of the heretofore-known devices and methods of this general type and which includes a plurality of supporting members that are flexible on one hand and are displaceable from a standby position into an operational position, while being self-supporting in an outstretched position, on the other hand.

With the foregoing and other objects in view, there is provided, in accordance with the invention, a machine for processing flat printing material, particularly a sheet-processing rotary printing press. The machine comprises at least one processing station formed as a printing unit, a feeder for loading the processing station with sheets of the printing material, a delivery for combining the processed sheets into piles, and an auxiliary pile carrier displaceable in an insertion direction from a standby position into an operational position and the reverse. Supporting members follow one another in the insertion direction. Axially parallel swivel joints articulatingly connect the supporting members directly to one another. The supporting members have extensions projecting beyond swivel joints thereof. One of the extensions being directed counter to the insertion direction of a respective one of the supporting members engaging underneath one of the extensions being directed in the insertion direction of the respective supporting member after the next trailing in the insertion direction.

In accordance with another feature of the invention, the machine further includes a guide through which the supporting members are to be pushed for the intended use thereof. The guide holds an extension, which is directed counter to the insertion direction and located in the guide, in contact with the extension directed in the insertion direction of the supporting member after the next trailing in the insertion direction.

In accordance with a further feature of the invention, the guide forms a support for the auxiliary pile carrier.

In accordance with an added feature of the invention, the machine further includes a guide track whereon the auxiliary pile carrier is supported in the standby position thereof.

In accordance with an additional feature of the invention, the guide track rises convexly. A lower end of the guide track faces the at least one processing station.

In accordance with yet another feature of the invention, the machine further includes a lifting/lowering unit for lifting and lowering the guide and the guide track jointly.

In accordance with yet a further feature of the invention, the supporting members, when located in operating position thereof, form an auxiliary pile supporting table.

In accordance with a concomitant feature of the invention, the supporting members, when located in operating position thereof, form individual rod-shaped supporting elements.

Depending on the geometry of the supporting members, an auxiliary pile or stack carrier configured in this manner represents an auxiliary pile or stack supporting table or a configuration of individual rod-shaped supporting elements, in the operating position of the supporting members.

In principle, it is possible to use such an auxiliary pile or stack carrier irrespectively of whether it forms an auxiliary pile or stack supporting table or individual rod-shaped supporting elements in the operating position for non-stop operation at the delivery. However, the embodiment forming rod-shaped supporting elements is preferably provided for use for non-stop operation at the feeder, and the geometry and the mutual distance between these supporting elements are provided in such a way that the supporting elements can be inserted into grooves which are customarily provided on pile or stack underlays in the form of grooved system pallets.

In any case, however, in order to move an auxiliary pile or stack carrier according to the invention into the operating position thereof, there is no need for a supporting device which is moved jointly with the auxiliary pile or stack carrier along the path of the auxiliary pile or stack carrier in an insertion direction from the standby position into the operating position and holds the auxiliary pile or stack carrier in an outstretched position during this movement.

Furthermore, the flexibility of the auxiliary pile or stack carrier, when it is used for non-stop operation in the feeder, is of particular advantage to the extent that the installation space below conventional feeding tables is sufficient to accommodate the auxiliary pile or stack carrier therein in the standby position thereof.

Other features which are considered as characteristic for the invention are set forth in the appended claims.

Although the invention is illustrated and described herein as embodied in a flat printing material-processing machine with an auxiliary pile or stack carrier, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
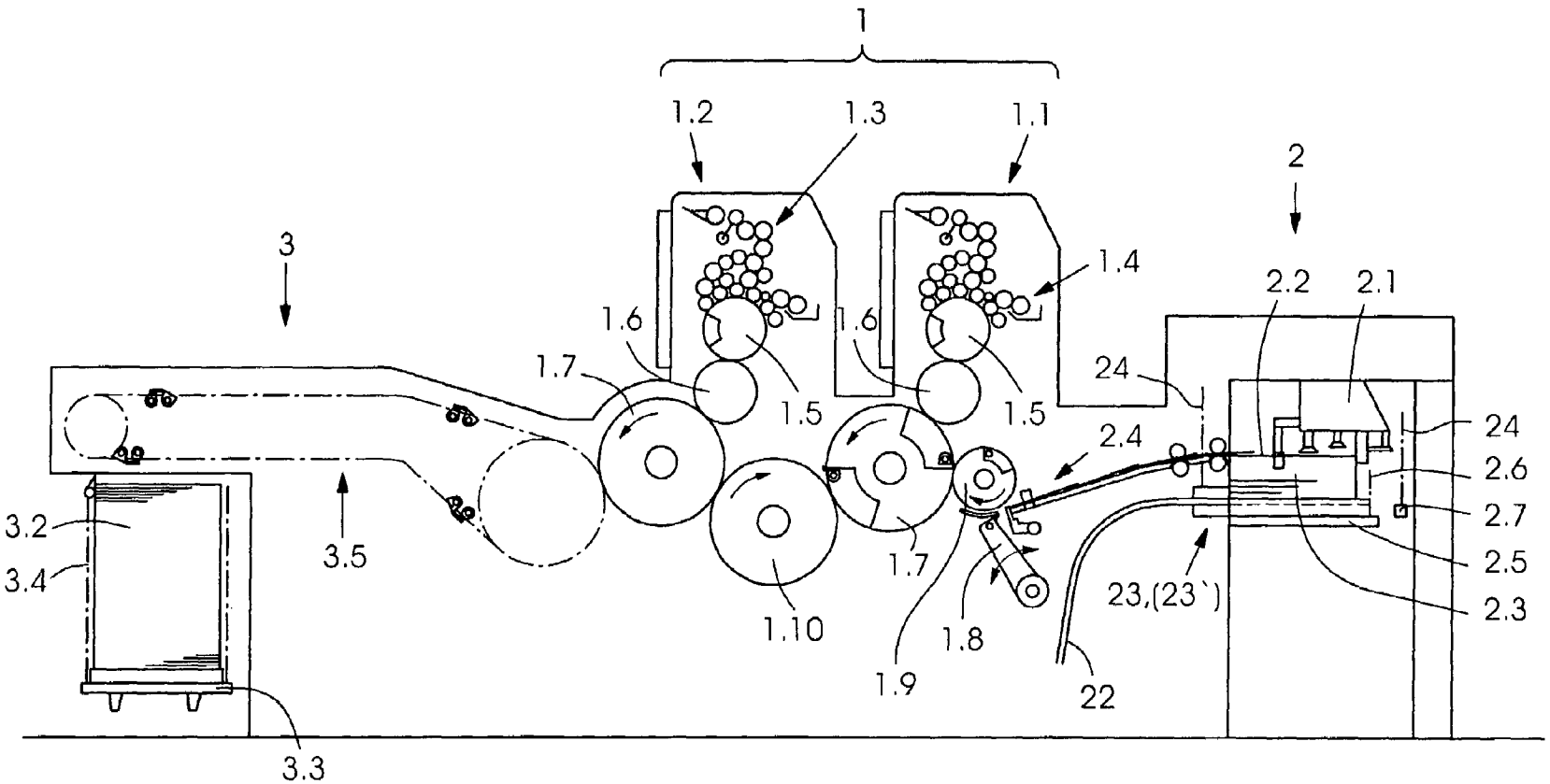
FIG. 1 is a diagrammatic, side-elevational view of a sheet processing rotary printing press having a feeder and a delivery wherein, by way of example, the feeder is equipped with an auxiliary pile or stack carrier represented in the figure only by a guide path therefor.

Referring now to the figures of the drawings in detail and first, particularly, to FIG. 1 thereof, there is seen a diagrammatic illustration of a sheet processing rotary printing press made up of a press section 1 with, by way of example, two processing stations in the form of printing units 1.1 and 1.2, by which two colors may be printed. A further printing unit must be provided for every further color to be printed. A respective further processing station must be provided for further process steps, such as varnishing, intermediate drying, perforating, and so forth. In the exemplary embodiment, the printing units 1.1 and 1.2 operate in accordance with the wet offset process and, accordingly, respectively include an inking unit 1.3 and a dampening unit 1.4, a plate cylinder 1.5 associated therewith, a blanket cylinder 1.6 rolling on the latter during operation, and an impression cylinder 1.7 for guiding a respective sheet.

In order to load the printing units 1.1 and 1.2 with sheets, a feeder 2 is provided for picking up a respective uppermost sheet 2.2 from a sheet pile or stack 2.3 via a separating or singling device 2.1 and transferring it to a transporting and aligning device 2.4 for aligning a respective preceding sheet of the separated sheets for forming an overlapping or imbricated formation against leading edge stops and against at least one lateral stop, after the sheet has been transported towards the leading edge stops, in particular, by a suction belt table.

An oscillating pregripper 1.8, assigned to the first processing station, in this case the printing unit 1.1, accepts the respectively aligned sheet 2.2 and transfers it to a feeder drum 1.9. For its part, the feeder drum 1.9 transfers the sheet to the impression cylinder 1.7 of the printing unit 1.1. After passing the printing nip of the printing unit 1.1, the impression cylinder 1.7 of the latter transfers the sheet 2.2 to a transfer device which is in the form of a sheet guiding drum 1.10 and is disposed between the impression cylinders 1.7 of the two printing units 1.1 and 1.2. In the case of a printing press configured for recto and verso or first-form and perfecter printing, a sheet reversing device convertible between recto or first-form printing and recto and verso or first-form and perfecter printing is provided instead. The impression cylinder 1.7 of the printing unit 1.2 accepts the sheet 2.2 from the sheet guiding drum 1.10, guides it through the farther printing nip and then transfers it to an endless, operatively revolving conveyor 3.5 of a delivery 3 ultimately forming a printed product pile or stack 3.2 of the respective sheets 2.2.

During production printing, the production level, i.e. the height or location in vertical direction of the respectively uppermost sheet 2.2, at the pile or stack 2.3 in the feeder 2, and the drop height of the released sheets 2.2 in the delivery 3, are maintained by suitable adjustment of respective platforms 2.5 and 3.3 for carrying the respective pile or stack 2.3 and the printed product stack 3.2. This is accomplished by respective lifting/lowering units, of which only diagrammatically illustrated lifting/lowering chains 2.6 and 3.4 for carrying the respective platforms 2.5 and 3.3 are shown.

As noted hereinbefore, an auxiliary pile or stack carrier of the type described hereinafter in greater detail is to be installed for the non-stop operation of both the feeder and the delivery. Hereinafter, however, a suitable installation of the feeder is described only by way of example.

Figure 2:
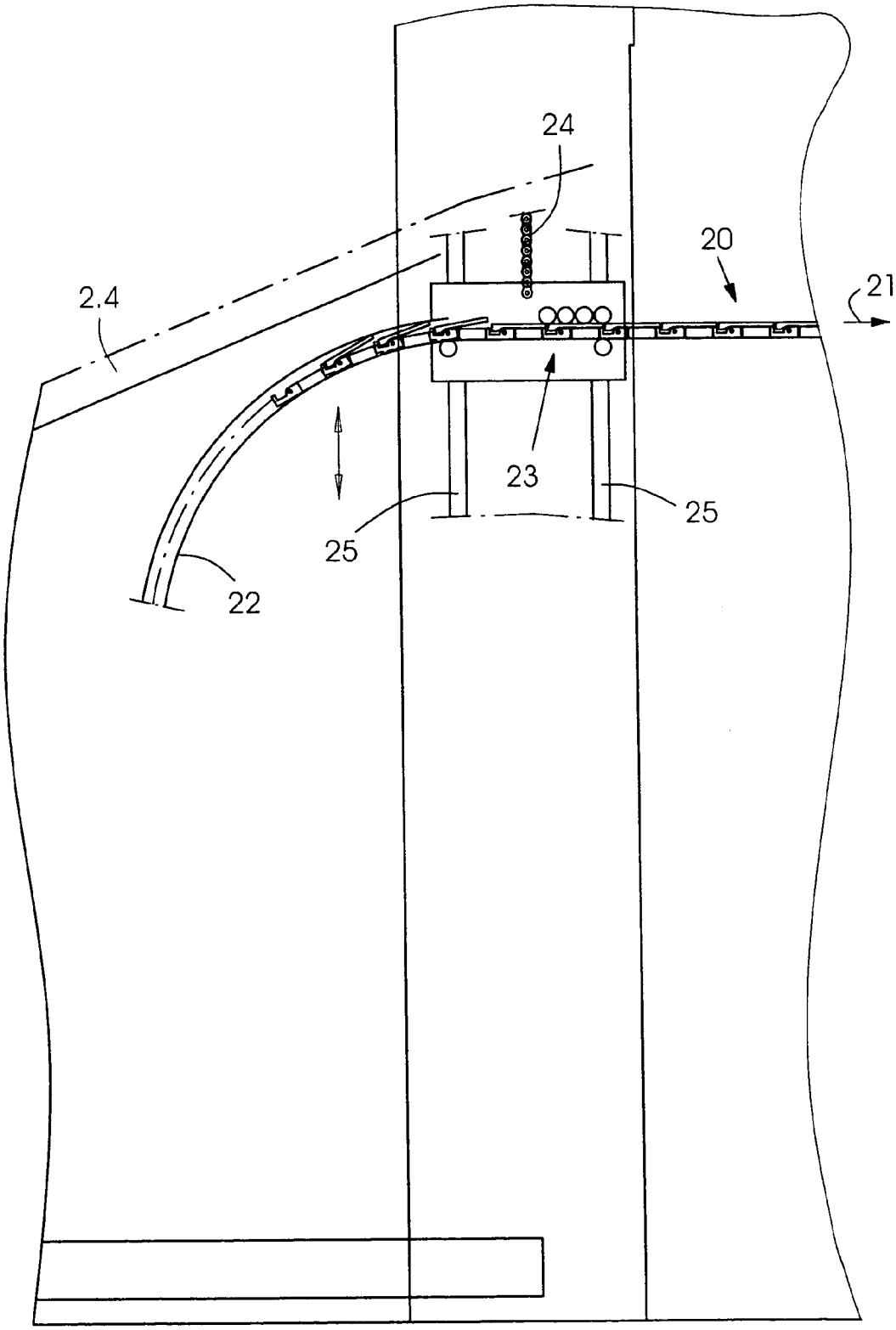
FIG. 2 is an enlarged, fragmentary, side-elevational view of a portion of FIG. 1 showing part of the feeder in a more simplified illustration as compared with that of FIG. 1.

To this extent, FIG. 2 shows part of the feeder according to FIG. 1 which is equipped, in particular, with an auxiliary pile or stack carrier 20. As explained hereinafter, the auxiliary pile or stack carrier 20 is, on one hand, flexible or, more precisely, articulated and, on the other hand, can be brought into an outstretched position. The flexibility of the auxiliary pile or stack carrier 20 serves for accommodating it in a space-saving manner in a standby position, in this case underneath the transporting and aligning device 2.4. The auxiliary carrier 20 is to be displaced from this standby position in an insertion direction represented by a direction arrow 21 into an operating position wherein an end of the auxiliary carrier 20 pointing in the insertion direction is supported on a cross member or traverse 2.7 which is liftable and lowerable (note FIG. 1). After the auxiliary pile or stack carrier has been used, i.e. after the largely or extensively processed pile or stack 2.3 has been combined conventionally with a new main pile or stack, the auxiliary pile or stack carrier 20 is displaced back into or returned to the standby position thereof.

The auxiliary pile or stack carrier 20 is made up of supporting members following one another in the insertion direction and directly articulated on or linked with one another by axially parallel rotary or swivel joints, and is to be brought or moved successively into a stretched or elongated position, in particular from the end thereof pointing in the insertion direction. In this way, as explained hereinafter in greater detail, the self-supporting length of the section in the outstretched position is always increased in the adjusting direction by the extent of one supporting member, starting from the end pointing in the insertion direction.

If the auxiliary pile or stack carrier 20 is subjected to tension horizontally at the end thereof pointing in the insertion direction 21, the auxiliary pile or stack carrier 20, in a condition thereof wherein it is otherwise unsupported, assumes a polygonally sloping shape contingent upon the geometry of the supporting members. In other words, when the auxiliary pile or stack carrier 20 is not moved into an outstretched position, it then lies within two curved enveloping surfaces, of which at least the lower one is configured, in a preferred refinement, in physical terms by a guide track 22 which thus rises convexly.

If the auxiliary pile or stack carrier 20 is disposed with the end thereof pointing in an insertion direction extending away from the printing unit 1.1 (note FIG. 1), a lower end of the guide track 22 thus faces towards the printing unit 1.1. The guide track 22 and consequently the auxiliary pile or stack carrier 20 supported on the latter in the standby position are advantageously inserted into the installation space, which is present in any case in conventional sheet processing rotary presses and decreases in height from the pile or stack 2.3 towards the printing unit 1.1, underneath the feeding table of the transporting and aligning device 2.4 (note FIG. 1).

As indicated in FIG. 2, the auxiliary pile or stack carrier 20 (represented therein only by a part of the length thereof), for the intended purpose thereof, is pushed through a guide 23 in the insertion direction represented by the arrow 21 from the standby position of the auxiliary pile or stack carrier 20 wherein it is supported on the guide track 22. The guide 23 is configured, as is explained in greater detail hereinafter, so that it then holds the section of the auxiliary pile and stack carrier 20 which has been pushed therethrough in an outstretched position. The guide track 22 disposed upstream from the guide 23 is assigned to the guide 23 so that the likewise hereinafter further-described supporting members of the auxiliary pile or stack carrier 20 enter the guide 23 as the supporting members leave the guide track 22. The guide track 22 thus supports the auxiliary pile or stack carrier 20 in the standby position thereof. The guide 23 and a component forming the guide track 22 preferably form a structural unit which is liftable and lowerable in order to provide the necessary height adjustability conventionally known for non-stop operation, by an auxiliary pile or stack lifting/lowering unit, of which only a lifting/lowering chain 24 and, by way of example, guide profiles 25 for guiding the guide 23, are diagrammatically illustrated herein.

Figure 3:
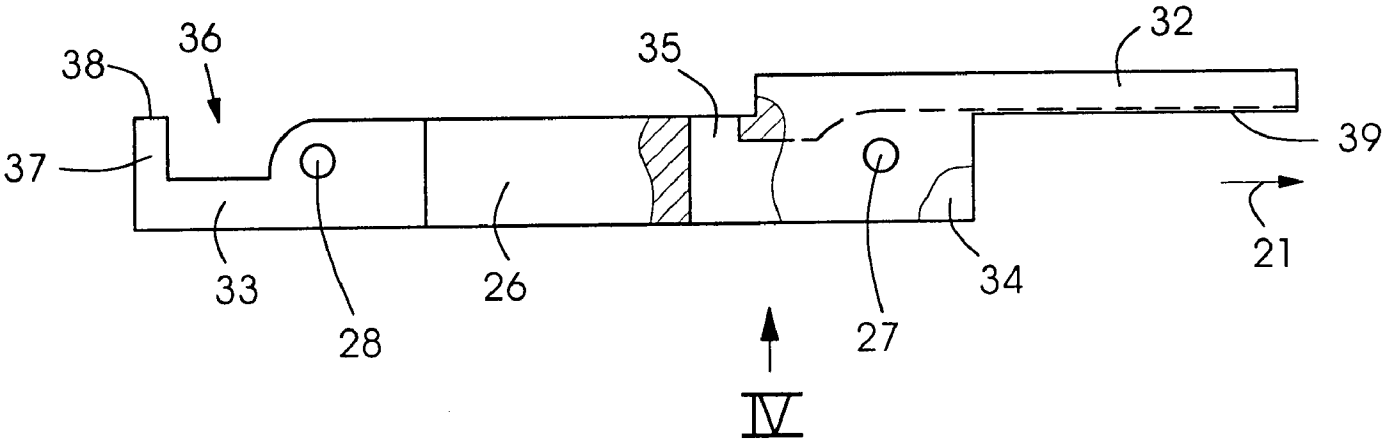
FIG. 3 is a side-elevational view of a supporting member of the auxiliary pile or stack carrier.

FIG. 3 diagrammatically illustrates an exemplary embodiment of a supporting member 26 of the auxiliary pile or stack carrier 20 in a side-elevational view corresponding to the views in FIGS. 1 and 2 and oriented, with respect to the insertion direction, in accordance with the indicated direction arrow 21 from the standby position into the operating position. The supporting member 26 has a base body formed with a first joint bore 27 at a first end of the base body pointing in the insertion direction represented by the direction arrow 21, and with a second joint bore 28 at a second end facing away from the first end of the base body. When a plurality of such successive supporting members 26 are directly articulated on or linked with one another, the hereinafore-mentioned joint bores 27 and 28, together with joint pins 29 inserted therein, form a first swivel joint 30 and a second swivel joint 31 with mutually parallel joint axes (note FIG. 5).

The supporting member 26 has a first extension 32, which protrudes beyond the first swivel joint 30 or the first joint bore 27, i.e. points in the insertion direction represented by the direction arrow 21 during the intended use thereof, and forms a first end of the supporting member 26. The supporting member 26 also has a second extension 33, which protrudes beyond the respective second swivel joint 31 and the second joint bore 28, i.e. points in a direction counter to the insertion direction, and forms a second end of the supporting member 26. In a section of the highest structural height in the intended position, the base body and the two extensions 32 and 33 occupy a space between two horizontal planes which are spaced apart by the structural height. An underside of the second extension 33 and of an adjoining section of the base body lies in the lower of the two planes, and an upper side of the first extension 32 and an upper side of an adjoining part of the base body lies in the upper plane. An underside of the first extension 32 and an upper side of the second extension 33 and of an adjoining section of the base body lie in a horizontal intermediate plane which extends between the two afore-mentioned planes.

In order to provide for a plurality of such supporting members 26 to articulate on or be linked to one another in a directly successive manner, the second joint bore 28 of a supporting member 26 is made to coincide with the first joint bore 27 of a supporting member 26 which is trailing it, as viewed in the insertion direction represented by the direction arrow 21. Similarly, the first joint bore 27 is made to coincide with the second joint bore 28 of a leading supporting member 26.

Figure 4A:
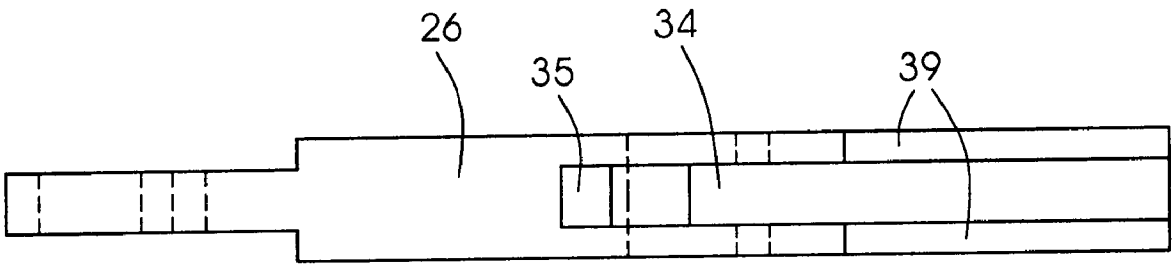
FIG. 4A is a bottom-plan view of FIG. 3, showing the supporting member as seen in the direction of an arrow IV in an embodiment wherein individual supporting elements are constructed by the supporting members.

As is recognizable from FIG. 4A, in a case wherein the auxiliary pile or stack carrier 20 is configured so that it forms rod-shaped supporting elements in the operating position, the widths of the respective second extension 33 and an adjoining section of the base body are reduced or narrowed on both sides for this purpose. The first extension 32 and an adjoining section of the base body are formed centrally, from the underside thereof, with a recess 34 so that a supporting member 26 which precedes it in the insertion direction 21 can be inserted into a subsequent supporting member 26 until the second joint bore 28 thereof is aligned with the first joint bore 27. Moreover, the upper sides of the second extension 33 and of the recess 34 are provided with a contour which permits the supporting members 26 to assume mutual swiveling positions (note FIG. 6).

Figure 5:
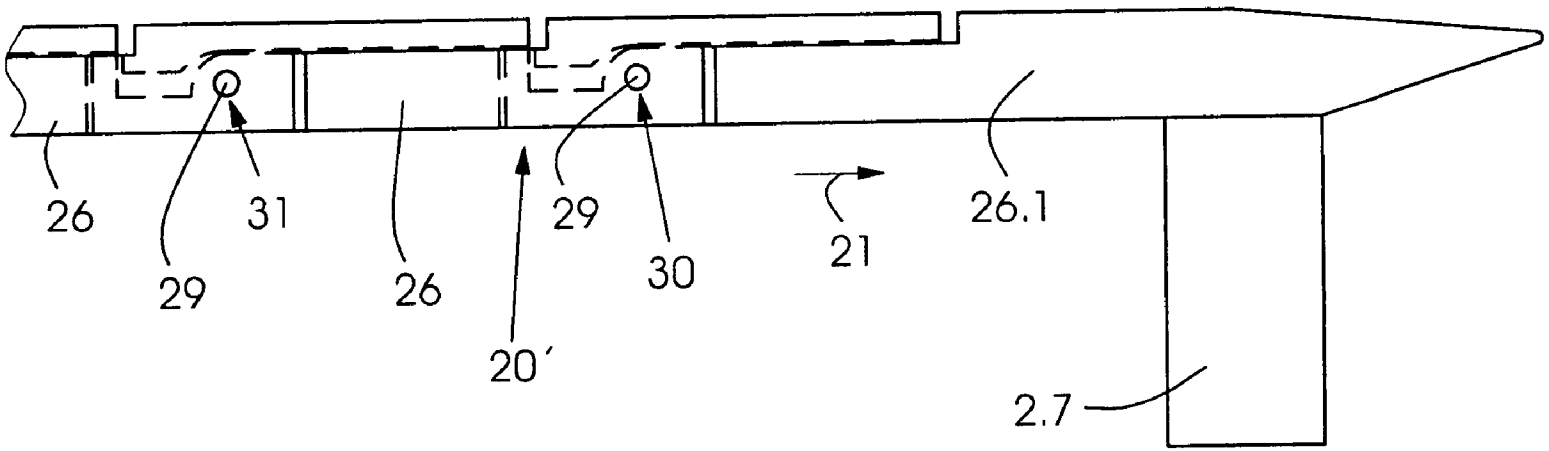
FIG. 5 is a fragmentary, side-elevational view of the auxiliary pile or stack carrier in an outstretched position, showing an end section extending in the insertion direction and a support whereon the end section of the auxiliary pile or stack carrier is supported in the operating position thereof.

Furthermore, as is apparent from FIG. 5, the base body and the two extensions 32 and 33 are configured in such a way that a respective second extension 33 of the respective mutually articulated or linked supporting members 26 engages underneath a first extension 32 of the supporting member 26 after the next which is trailing with respect to the insertion direction represented by the direction arrow 21.

As can furthermore be seen from FIG. 3, the recess 34, at the end thereof facing towards the second joint bore 28, forms an aperture 35 which penetrates the upper side of the supporting member 26. The second extension 33, at the free end thereof, has, following a depression 36 provided for permitting the afore-mentioned mutual swiveling positions of the supporting members 26, a stop 37 with an upper side forming a first stop surface 38 lying in the intermediate plane already mentioned hereinbefore. The distances, on one hand, between the stop 37 and the second joint bore 28 and, on the other hand, between the aperture 35 and the first joint bore 27, and the geometry of the stop 37 and the aperture 35 are selected in such a way that, in the mutually articulated or linked condition of the supporting members 26, the stop 37 of a preceding supporting member 26 can penetrate the aperture 35 of the supporting member 26 trailing thereafter in the insertion direction 21.

As is apparent in FIG. 5, the length of the first extension 32 is selected in such a way that the underside thereof, likewise lying in the aforementioned intermediate plane as already noted hereinabove, rests, in the outstretched position of the auxiliary pile or stack carrier 20, on the first stop surface 38 of the supporting member 26 after the next which precedes it in the insertion direction 21 and thus forms a second stop surface 39.

Figure 8:
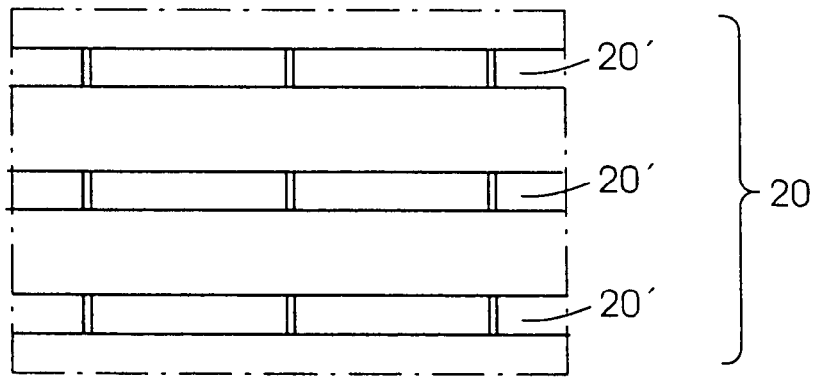
FIG. 8 is a fragmentary, plan view of a different embodiment of the auxiliary pile or stack carrier, wherein it is shown constructed in the form of individual rod-shaped supporting elements.

Otherwise, the geometry of the supporting members depends upon whether the latter are to form an auxiliary pile or stack table, or individual rod-shaped supporting elements 20' in the operating position (note FIG. 8).

Figure 4B:
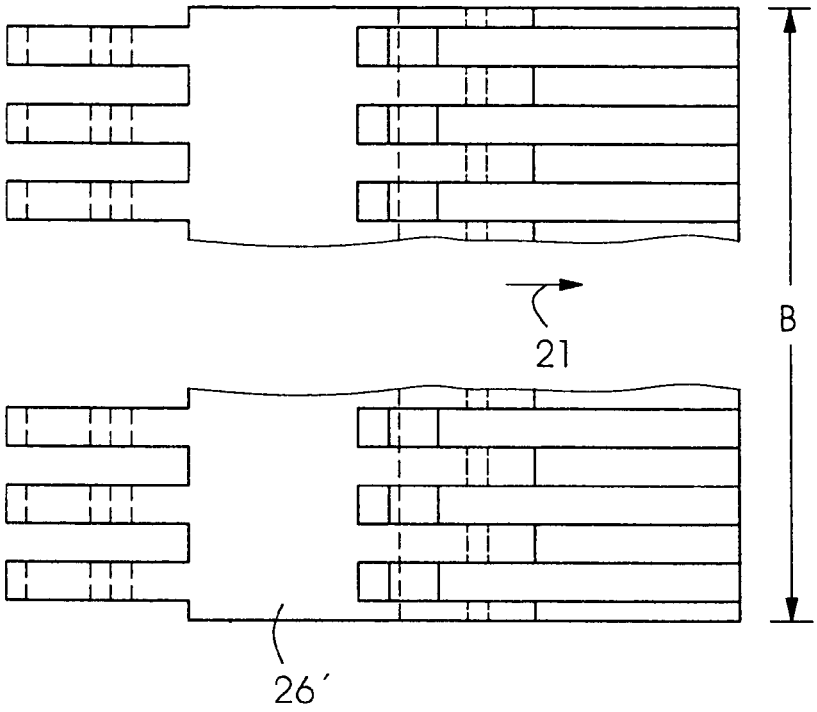
FIG. 4B is a partly broken-away view similar to that of FIG. 4A showing supporting members as seen in the direction of the arrow IV in FIG. 3 in an embodiment of an auxiliary pile or stack supporting carrier or table constructed by the supporting members.

The rod-shaped supporting elements 20' can be produced with a geometry corresponding to that of FIG. 4A, while an auxiliary pile or stack table can be produced with a geometry corresponding to that of FIG. 4B, it being noted that FIGS. 4A and 4B, respectively, are a view of the underside of a supporting member.

Figure 6:
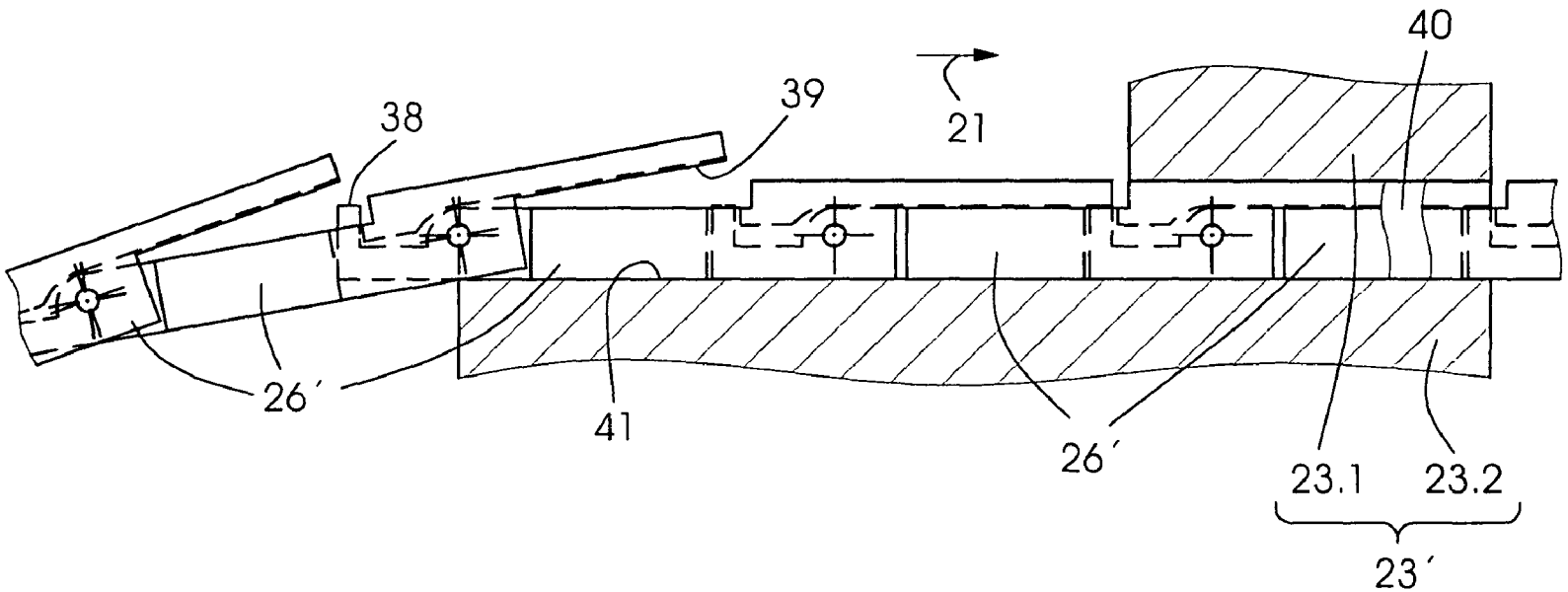
FIG. 6 is a fragmentary, side-elevational view of the auxiliary pile or stack carrier in a position wherein it is pushed into a guide.

FIG. 6 shows an exemplary embodiment 23' of the heretofore mentioned guide 23, now described in greater detail, and the interaction or cooperation thereof with the supporting members 26' according to FIG. 4B, which are provided here, by way of example, for producing an auxiliary pile or stack table. Referring to the insertion direction represented by the direction arrow 21, the guide 23' is disposed downstream of the guide track 22 (not shown in FIG. 6, but note FIG. 2) and in the case at hand is formed of an upper pressure member configuration 23.1 and a lower pressure member configuration 23.2 which are disposed on the aforementioned auxiliary pile or stack lifting/lowering unit and form a horizontal gap 40 therebetween.

In the case serving as a basis, by way of example, for configuring the supporting members 26' in accordance with FIG. 4B, for producing an auxiliary pile or stack supporting table, the pressure member configurations 23.1 and 23.2 can be restricted to lateral regions of the supporting members 26' with respect to the insertion direction represented by the direction arrow 21, or it is possible to dispose a number of upper and lower pressure member configurations 23.1 and 23.2 distributed across the width B (note FIG. 4B) of the supporting members 26'.

The geometry of the gap 40 is selected so that, while the supporting members 26' are being pushed through the gap 40, the first stop surface 38 of a supporting member 26' preceding in the insertion direction is constantly kept positively in contact with the second stop surface 39 of the supporting member 26' after the next trailing in the insertion direction, by the upper and the lower pressure member configuration 23.1 and 23.2, respectively.

The gap 40 is preceded by a horizontal aligning surface which is configured, in the example at hand, on the lower pressure member configuration 32.2 and, in another refinement, can also be provided on the guide track 22 shown in FIG. 2. The aligning surface 41 serves for aligning the supporting members 26' beforehand in the outstretched position thereof before they then enter the gap 40 in that position.

Due to the mutual contact, imposed in the gap 40, of the first stop surface 38 of one of the supporting members 26' against the second stop surface 39 of the trailing supporting member 26' after the next with respect to the former supporting member 26', there is a preclusion of any mutual swiveling movement of those supporting members 26' which leave the gap 40 again as they are pushed through the latter. The auxiliary pile or stack carrier 20 thus leaves the gap 40 in an outstretched position of the supporting members 26', so that the self-supporting section of the auxiliary pile or stack carrier 20 is successively lengthened by a supporting member 26' as the supporting members 26' are pushed through.

Figure 7:
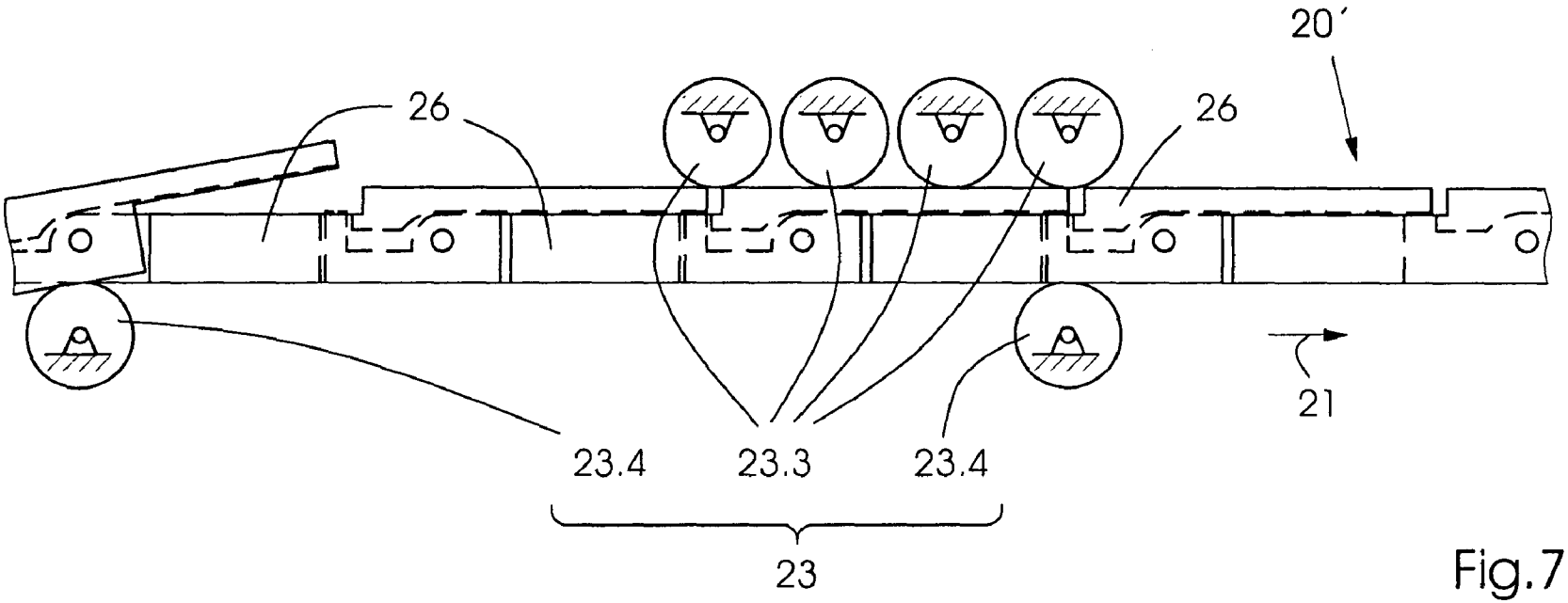
FIG. 7 is a view similar to that of FIG. 6 showing a different embodiment of the guide into which the auxiliary carrier is pushed.

In FIG. 7, there is shown a guide 23, which has already been illustrated in FIG. 2 and is configured differently from the guide 23' shown in FIG. 6. Also clear from FIG. 7 is the interaction or cooperation of the guide 23 with the supporting members 26 provided here, by way of example, for forming rod-shaped supporting elements 20'.

Instead of the pressure member configurations 23.1 and 23.2 forming rigid guide surfaces, in the exemplary embodiment at hand, this guide 23 is made up of four clamping rollers 23.3, mounted on the aforementioned auxiliary pile or stack lifting/lowering unit and set against the upper side of the rod-shaped supporting element 20', and two supporting rollers 23.4 which are likewise mounted on the auxiliary pile or stack lifting/lowering unit and support the supporting element 20' on the underside thereof. The supporting roller 23.4, which is disposed upstream with respect to the insertion direction represented by the direction arrow 21, is spaced apart from the other of the two supporting rollers 23.4 to such an extent that the supporting members 26 are aligned in the outstretched position thereof before they come into contact with the clamping rollers 23.3 as the supporting members are displaced in the insertion direction represented by the direction arrow 21. Moreover, the configuration of the clamping rollers 23.3 and the supporting rollers 23.4 is selected so that, as the supporting members 26 are pushed through the guide 23, the first stop surface 38 of a supporting member preceding in the insertion direction, while the first stop surface 38 passes the clamping rollers 23.3, is constantly kept positively in contact with the second stop surface 39 of the supporting member 26 after the next which trails in the insertion direction by the clamping rollers 23.3 and the supporting rollers 23.4. With regard to production tolerances, the clamping rollers 23.3 or the supporting rollers 23.4 are preferably disposed and mounted so that they can be deflected by the supporting members 26 or 26' counter to a restoring force.

The auxiliary pile or stack lifting/lowering unit, which has already been mentioned herein in connection with FIG. 2, furthermore includes, as shown in FIG. 1, a liftable and lowerable cross member or traverse 2.7 shown in cross section in FIG. 1, whereon the end of the auxiliary pile or stack carrier 20, pointing in the insertion direction represented by the direction arrow 21, is supported in the operating position of the latter.

As is apparent from FIG. 5, for the case of the auxiliary pile and stack carrier 20 being configured by individual rod-shaped supporting elements 20', corresponding support is preferably provided by a respective terminal supporting member in the form of an end member 26.1 of a supporting element 20'. This end member 26.1 is configured analogously to the supporting members 26 only in a section facing a trailing supporting member 26 and preferably has a chamfer provided on the underside thereof at the other end thereof, namely the free end. The chamfer permits reliable placement on the cross member or traverse 2.7 when the auxiliary pile or stack carrier 20 is moved into the operating position thereof. After the auxiliary pile or stack carrier 20 has been moved into the operating position thereof, there remains in the region of the other end of the auxiliary pile or stack carrier an adequate number of supporting members 26 or 26' in the region of influence of the guide 23 or 23' so that that part of the auxiliary pile or stack carrier 20 which has emerged from the guide 23 or 23' in the insertion direction represented by the direction arrow 21 is kept in the outstretched position. To this extent, the guide 23 or 23' forms a support for the auxiliary pile or stack carrier 20.

In particular, for the case wherein the auxiliary pile or stack carrier 20 is configured by individual rod-shaped supporting elements 20', in an advantageous refinement, the auxiliary pile or stack carrier 20 is connected at the trailing end thereof with respect to the insertion direction represented by the direction arrow 21 to an endless flexible drive (not otherwise shown in greater detail), by which the displacement operations of the auxiliary pile or stack carrier 20 between the standby position and the operating position thereof are performed.

A further advantageous possibility of displacement between the standby position and the operating position is produced by rollers which are mounted in a fixed position, set against an upper side and against an underside of the auxiliary pile or stack carrier 20 in the region of the guide 23 or 23' or directly in front of or behind the latter, at least one of these rollers being driven. In the case of the guide 23 being configured in accordance with FIG. 7, the supporting roller 23.4 lying downstream with respect to the insertion direction can be driven, for example. Moreover, a roller drive of this type can be used, as can the aforementioned flexible drive, independently of whether the auxiliary pile or stack carrier 20 is an auxiliary pile or stack table or individual rod-shaped supporting elements 20'.

In the case wherein the guide track 22 is configured in the shape of a circular arc, a motor-actuated swiveling lever configuration which is articulated at the trailing end of the auxiliary pile or stack carrier 20 can also be provided as an alternative actuating device.

At those sides of the supporting members 26 or 26' which come into contact with the printing materials, the surfaces of the supporting members 26 or 26' are preferably configured so that they can slide along on the printing materials without damaging them.

We claim:

1. A machine for processing flat printing material, comprising:

at least one processing station in the form of a printing unit;

a feeder for loading said at least one processing station with sheets of the printing material;

a delivery for combining the processed sheets into piles;

an auxiliary pile carrier to be displaced in an insertion direction from a standby position into an operational position and back to said standby position, said auxiliary pile carrier having supporting members following one another in said insertion direction; and axially parallel swivel joints for articulatingly connecting said supporting members directly to one another;

said supporting members having extensions projecting beyond said swivel joints, one of said extensions being directed counter to said insertion direction and engaging underneath one of said extensions being directed in said insertion direction of the next said supporting member trailing in said insertion direction.

2. The machine according to claim 1, further comprising a guide through which said supporting members are to be pushed for use of said supporting members, said guide holding said extension being directed counter to said insertion direction and located in said guide, in contact with said extension being directed in said insertion direction of said supporting member after the next trailing in said insertion direction.

3. The machine according to claim 2, wherein said guide forms a support for said auxiliary pile carrier.

4. The machine according to claim 2, further comprising a guide track, said auxiliary pile carrier being supported on said guide track in said standby position of said auxiliary pile carrier.

5. The machine according to claim 4, wherein said guide track rises convexly and has a lower end facing said at least one processing station.

6. The machine according to claim 4, further comprising a lifting/lowering unit for lifting and lowering said guide and said guide track jointly.

7. The machine according to claim 1, wherein said supporting members form a supporting table when located in said operating position.

8. The machine according to claim 1, wherein said supporting members form individual rod-shaped supporting elements when located in an operating position of said supporting members.

9. A sheet-processing rotary printing press for processing flat printing material, comprising:

at least one processing station in the form of a rotary printing press printing unit;

a feeder for loading said at least one processing station with sheets of the printing material;

a delivery for combining the processed sheets into piles;

an auxiliary pile carrier to be displaced in an insertion direction from a standby position into an operational position and back to said standby position, said auxiliary pile carrier having supporting members following one another in said insertion direction; and axially parallel swivel joints for articulatingly connecting said supporting members directly to one another;

said supporting members having extensions projecting beyond said swivel joints, one of said extensions being directed counter to said insertion direction and engaging underneath one of said extensions being directed in said insertion direction of the next said supporting member trailing in said insertion direction.

* * * * *